US009795968B2

(12) United States Patent
Dugan

(10) Patent No.: US 9,795,968 B2
(45) Date of Patent: Oct. 24, 2017

(54) MULTI-CHAMBER NUCLEIC ACID AMPLIFICATION AND DETECTION DEVICE

(71) Applicant: Lawrence Dugan, Modesto, CA (US)

(72) Inventor: Lawrence Dugan, Modesto, CA (US)

(73) Assignee: Lawrence Livermore National Security, LLCq, Livermore, CA (US)

( * ) Notice: Subject to any disclaimer, the term of this patent is extended or adjusted under 35 U.S.C. 154(b) by 0 days.

(21) Appl. No.: 14/257,313

(22) Filed: Apr. 21, 2014

(65) Prior Publication Data

US 2015/0298129 A1 Oct. 22, 2015

(51) Int. Cl.

| | |
|---|---|
| ***B01L 1/00*** | (2006.01) |
| ***B01L 3/00*** | (2006.01) |
| ***B01L 7/00*** | (2006.01) |

(52) U.S. Cl.

CPC ..... *B01L 7/52* (2013.01); *B01L 3/50851* (2013.01); *B01L 3/502715* (2013.01); *B01L 3/502738* (2013.01); *B01L 2200/027* (2013.01); *B01L 2300/0803* (2013.01); *B01L 2300/0864* (2013.01); *B01L 2400/0406* (2013.01); *B01L 2400/0478* (2013.01); *B01L 2400/0655* (2013.01)

(58) Field of Classification Search

CPC ..... B01L 3/5027; B01L 3/50273; B01L 3/502738; B01L 2200/06; B01L 2400/066; B01L 2300/0864; B01L 2200/0642

See application file for complete search history.

(56) References Cited

U.S. PATENT DOCUMENTS

| | | | | |
|---|---|---|---|---|
| 5,585,069 | A * | 12/1996 | Zanzucchi et al. | 422/505 |
| 5,639,428 | A * | 6/1997 | Cottingham | 422/112 |
| 5,882,903 | A * | 3/1999 | Andrevski et al. | 435/91.2 |
| 6,300,138 | B1 * | 10/2001 | Gleason et al. | 436/165 |
| 6,730,883 | B2 * | 5/2004 | Brown et al. | 219/428 |

(Continued)

OTHER PUBLICATIONS

Dukes, et al., "Novel Reverse Transcription Loop-Mediated Isothermal Amplification for Rapid Detection of Foot-and-Mouth Disease Virus", Arch Virol., 151:1093-1106 (2006).

(Continued)

*Primary Examiner* — Nathan Bowers
(74) *Attorney, Agent, or Firm* — James S. Tak

(57) ABSTRACT

A nucleic acid amplification and detection device includes an amplification cartridge with a plurality of reaction chambers for containing an amplification reagent and a visual detection reagent, and a plurality of optically transparent view ports for viewing inside the reaction chambers. The cartridge also includes a sample receiving port which is adapted to receive a fluid sample and fluidically connected to distribute the fluid sample to the reaction chamber, and in one embodiment, a plunger is carried by the cartridge for occluding fluidic communication to the reaction chambers. The device also includes a heating apparatus having a heating element which is activated by controller to generate heat when a trigger event is detected. The heating apparatus includes a cartridge-mounting section which positioned a cartridge in thermal communication with the heating element so that visual changes to the contents of the reaction chambers are viewable through the view ports.

12 Claims, 8 Drawing Sheets

(56) References Cited

U.S. PATENT DOCUMENTS

| | | | | |
|---|---|---|---|---|
| 6,949,377 | B2 * | 9/2005 | Ho | 435/287.1 |
| 7,122,153 | B2 * | 10/2006 | Ho | 422/417 |
| 2005/0093087 | A1 * | 5/2005 | Kadel | F16K 99/0001 257/415 |
| 2005/0214161 | A1 * | 9/2005 | Gupta | G01N 33/5091 422/400 |
| 2009/0142745 | A1 * | 6/2009 | Breidenthal et al. | 435/3 |
| 2015/0024477 | A1 * | 1/2015 | Mori et al. | 435/288.7 |
| 2015/0308578 | A1 * | 10/2015 | Block, III | F04B 43/1269 137/1 |

OTHER PUBLICATIONS

Kurosaki, et al., "A Simple and Sensitive Method for Detection of Bacillus Anthracis by Loop-Mediated Isothermal Amplification", Journal of Applied Microbiology, 107, pp. 1947-1956 (2009).

Bearinger, et al., "Development and Initial Results of a Low Cost, Disposable, Point-of-Care Testing Device for Pathogen Detection", IEEE Transactions on Biomedical Engineering, vol. 58, pp. 805-808 (2011).

Torres, et al., "LAVA: An Open-Source Approach to Designing Lamp (Loop-Mediated Isothermal Amplification) DNA Signatures", BMC Bioformatics, 12:240, 7 pages (2011).

* cited by examiner

MULTI-CHAMBER NUCLEIC ACID AMPLIFICATION AND DETECTION DEVICE

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

The present invention is generally directed to nucleic acid amplification assays, and more particularly to a multi-chamber, nucleic acid amplification and detection device for identifying biological organisms by visual detection without the need for sample preparation and nucleic acid purification/isolation.

BACKGROUND

Nucleic acid amplification and detection typically requires extensive sample preparation and nucleic acid extraction procedures utilizing laboratory equipment, followed by amplification of the extracted nucleic acid and detection of the amplification product which requires additional equipment.

Detection of nucleic acid without extensive sample preparation simplifies the process and shortens the time from sample-to-answer. This may allow more rapid detection of naked nucleic acid, genetic markers or pathogenic microorganisms in clinical, food testing, agricultural, environmental and field samples. For example, Loop-mediated isothermal amplification (LAMP) is one example technique that does not require extensive sample prep or nucleic acid isolation. LAMP was first described in the article "Loop-mediated Isothermal Amplification of DNA" by Notomi, et al., 2000, *Nuc Ac Res,* 28(12):e63, and is an isothermal technique which amplifies a target sequence at a constant temperature using either two or three sets of primers, and a DNA polymerase with high strand displacement activity in addition to replication activity (e.g. DNA polymerase from *Bacillus stearothermophilus* (Bst pol), which has optimal activity at 60-65° C.). Typically LAMP utilizes four different primers: forward and reverse outer primers, F3 and B3 respectively, and forward and reverse inner primers, FIP and BIP, respectively, that target six distinct sequences on the template nucleic acid. The addition of reverse transcriptase into the reaction, termed reverse-transcription LAMP or RT-LAMP, allows for the detection of RNA templates under the same conditions. Additionally, the addition of loop primers was subsequently shown to increase the rate of the reaction, reducing overall amplification times significantly (Nagamine, et al., 2002, *Mol Cell Probes,* 16:223-229). Thus a complete set of LAMP primers includes: outer primers F3 and B3, inner primers FIP and DIP, and forward and reverse loop primers, LF and LB, respectively.

Various detection methods have been reported for LAMP, including turbidity, fluorescence and gel electrophoresis (reviewed in Panda, 2008, *Rev Med Virol*, DOI: 10.1002/rmv.593). Additionally, colorimetric detection of positive LAMP reactions using Hydroxynaphthol blue dye (HNB) was described in an article by Goto, et al., 2009, *Biotechn,* 46(3):167-172. Solutions of HNB undergo a color change as cation levels drop (Brittain 1978, *Analyt Chim Acta,* 96:165-170). LAMP reactions generate a significant amount of pyrophosphate byproduct as supplied 2'-Deoxyribonucleotide-5'-Triphosphates (dNTPs) are added to amplification product. The pyrophosphate bonds with free $Mg^{2+}$ in the reaction mixture, reducing the cation level. This results in the solution undergoing a purple to blue color change easily detectable with the human eye.

Recently, several groups have published LAMP assays for the detection of *B. anthracis* (Qiao, et al., 2007, *Biotechnol Lett,* 29:1939-1946; Kurosaki 2009; Hatano, et al., 2010, *Jpn J Infect Dis,* 63:36-40; Jain, et al., 2011, *World J Microbiol Biotechnol,* 27:1407-1413). Qiao and coworkers originally reported detection of three gene targets representing the *B. anthracis* plasmids, pXO1 (pag) and pXO2 (capB), along with a chromosome target (Ba813) using LAMP. They reported a lower limit of detection of 10 spores (Qiao 2007) using fluorescence and gel electrophoresis. Kurosaki, et al. reported detection of three *B. anthracis* target genes (pag, capB, and sap), again representing the two plasmids and chromosome, respectively. They reported a limit of detection for pag of 10 fg per reaction in ~30 min using purified DNA and real-time turbidity detection (Kurosaki 2009). Additionally, they reported detecting target DNA from spores isolated from blood of intra-nasally infected mice (Kurosaki 2009). Hatano and coworkers reported detecting 1000 copies of pag and capB target DNA using LAMP along with a low-cost pocket warmer as a heating source (Hatano 2010). Most recently, DNA isolated from spores spiked into soil and talcum powder was detected by LAMP targeting the pag gene on pXO1 (Jain 2011).

Previous reports describing the detection of *B. anthracis* using LAMP have all used isolated DNA as template, whether extracted using phenol/chloroform (Hatano 2010), commercial kits (Kurosaki 2009) or boiling of spores (Qiao 2007, Kurosaki 2009, Jain 2011). These procedures produce quality DNA preparations suitable for PCR and LAMP, but require a minimum of 1 hour to perform and laboratory equipment such as tabletop centrifuges capable of speeds >10K RPM. Researchers recently showed direct detection of nucleic acid from solid and liquid cultures of *B. anthracis* without time consuming nucleic acid extraction and purification (Dugan et al. 20012, *J Microbiol Methods,* 90:280-284). Cultures were either loaded directly into the reaction mixture or diluted in buffer and then loaded into the reaction.

SUMMARY

Generally, the present invention is directed to a multi-chamber, nucleic acid amplification and detection device (alternatively, platform, system, or kit) and method, for identifying, in situ or at point-of-care, genetic markers of, for example, biological threat organisms (e.g. *B. anthracis*) and/or other pathogens in fluid samples by visually detecting (e.g. colorimetrically, by fluorescence, turbidity, infrared, etc.) associated DNA and/or RNA, without the need for sample preparation and nucleic acid isolation. It is appreciated that fluidic samples interrogated by the present invention may be environmental/in-field, laboratory and clinical samples. The device includes two main components, to which the present invention is also directed individually: the first, an amplification cartridge/test unit having multiple individual chambers (i.e. "reaction chambers") for containing (e.g. pre-loaded with) reaction components suitable for amplification and naked-eye visual detection, and the second, a heating apparatus/unit particularly configured and adapted to receive the amplification cartridge so that heating elements on the heating apparatus are positioned to heat the reaction chambers and its contents.

Multi-Chamber Amplification Cartridge

The multi-chamber amplification cartridge generally includes a cartridge body having a plurality of reaction chambers, and a device, construction, implement, or other means, for occluding fluid communication to the reaction chambers to seal contents therein. The cartridge body may have a disc-shaped design or construction, or any other body shape suitably dimensioned to be received in a heating apparatus of the present invention (such as for example shown at 30 in FIG. 6) to be heated thereby.

The cartridge body has multiple reaction chambers (i.e. two or more, such as tens or hundreds of chambers) for containing a reaction mixture including an amplification reagent (e.g. lyophilized amplification reagent) and a visual detection reagent (i.e. a reagent which produces a visually detectable change upon reacting with a target substance), and optionally others, which enables naked-eye colorimetric detection via optically transparent windows/view ports for viewing reaction progress following sample loading and amplification. The multiple chambers may be used for simultaneous detection of multiple target genetic sequences of target organisms, and reaction positive and negative controls. For example, the amplification cartridge may consist of ten chambers, one for each listed target, a negative control chamber and a reaction-positive chamber. It is appreciated that the reaction chambers may be provided, for example, as cavities integrally formed in the cartridge body (as shown in FIGS. 1-3), or in the alternative as separately-formed structures (not shown) connected to and carried by the cartridge body.

The cartridge body and the optically transparent windows covering the reaction chambers may be constructed using various types of materials (transparent materials for the windows), such as for example, various types of plastics, Teflon/PTFE, polypropylene (PP), polystyrene (PS), polylactic acid (PLA), nylon, polyethylene, polyurethane, acrylonitrile butadiene styrene (ABS), epoxy resin, phenolic resin, silica, etc. Preferably the cartridge body is made of a material that does not leach chemicals known to inhibit or other negatively affect amplification reaction or colorimetric detection, and/or are high impact resistance plastics which will not fracture into sharp pieces. And the reaction chambers (i.e. chamber/well walls and the optically transparent windows) also preferably has a construction designed for long-term storage of lyophilized reagents, especially if reagents are pre-loaded in the reaction chambers.

The amplification cartridge also includes a sample receiving port or buffer chamber and microfluidic channels arranged to uniformly deliver fluid sample to reaction chambers and reagents. The sample receiving port may be constructed from a flexible or otherwise resiliently biasing material, e.g. rubber, so as to be squeezable. And the sample receiving port may be fluidically connected to a distributions chamber for directing (e.g. when the sample receiving port is squeezed) a fluid sample to the distribution chamber, from which the sample may then be uniformly delivered/distributed to each of the reaction chambers. The sample receiving port may also include a rubber cap to prevent any backflow/leakage following sample injection and removal of the sample transfer device.

The amplification cartridge also includes a mechanism, device, construct, material, implement or other means, for occluding fluid communication to the reaction chambers so as to seal contents in the reaction chambers, such as for example, one or more of: a plunger, O-ring, wax beads, open-close valve, heat seal, film seal, epoxy resin seal. In particular, such means may be, for example, a plunger assembly having a plunger actuably mounted in relation to a distribution chamber operating as a fluid conduit between a sample receiving port and the multiple reaction chambers, and moveable from a non-occluding position enabling the distribution chamber to pass fluid between the sample receiving port and the multiple reaction chambers, to an occluding position which disables the distribution chamber from passing fluid between the sample receiving port and the multiple reaction chambers.

Amplification Reagents, Visual Detection Reagents

Various reagent types may be used in the reaction mixture contained in the reaction chambers, such as for isothermal amplification. For example, DNA oligo primers may be used, including for example LAMP primers which are designed to identify each of eight target organisms: *Bacillus anthracis, Yersinia pestis, Francisella tularensis, Clostridium botulinum*, Castor bean extract, Variola major/pox family, *Brucella suis/Brucella* spp. and *Staphylococcus aureus*. Also detection reagent may be used, such as for example one or more of the following: hydroxynaphthol blue; picogreen dye; sybr green dye; eva green dye; ethidium bromide, etc. Other reagents may include, for example, one or more of the following: buffer (ThermoPol reaction buffer (NEB, Ipswich, Mass.); deoxyribonucleotides; betaine; magnesium sulfate; bst polymerase water; protease inhibitors; and lyophilization stabilizers. In an example embodiment, the reaction chambers are pre-loaded/filled with reagents prior to final assembly of cartridge. Additionally, the pre-loaded reagents may be lyophilized. As such, the cartridge may be labeled with expiration date.

Heating Unit

The heating unit or apparatus of the present invention generally includes a cartridge mounting section that is adapted and configured to receive an amplification cartridge that may be loaded onto it for heating the reaction chambers. In particular, the mounting section is adapted so that the reaction chambers of a mounted cartridge are in thermal communication with a heating element (or sub-elements) and so that visual changes to the contents of the reaction chambers are viewable through the optically transparent view ports of the cartridge. The cartridge mounting section also includes a controller for controlling reaction start and stop times, an onboard power source or an off-board power source connector. In this manner, the heating unit may be used to maintain an optimum reaction temperature(s) across the reaction chambers. An activation switch may be provided for initiating the controller to heat the reaction chambers, and optionally, an indicator light may also be provided.

A cover section or outer shell (nonconductive) may also be provided as part of the heating unit and adapted to engage the cartridge-mounting section, for covering the mounting section and any cartridge that may be positioned thereon. The cover section may have optically transparent windows arranged to align with the optically transparent view ports of a mounted cartridge for viewing reaction progress. It is appreciated that the view ports on the heater unit's cover may either be an opening or cutout, or an optically transparent material. The heating unit may, for example, be suitably dimensioned for handheld use and portability. For example, the heating unit may have dimensions 150×80×20 mm so as to be capable of fitting into clothes pocket, with the cartridge slightly less to fit in the heating unit.

When closed (i.e. the cover positioned to engage the mounting section to encase a cartridge therein), the heating unit or apparatus may be adapted to perform one or more of:

occluding/sealing off the amplification chamber to prevent backflow and contamination between reaction chambers/wells, automatically initiating heating, and tracking reaction start and stop times using a time circuit (e.g. by triggering a switch connected to the controller). With respect to sealing of the reaction chambers, the cover may be arranged to automatically activate the occlusion and sealing of the reaction chambers (e.g. depression of the plunger of a mounted cartridge) when the cover is displaced to engage the mounting section. It is appreciated that the cartridge, in the alternative, may be adapted to be manually sealed prior to loading into heater apparatus. And with respect to automatic heating of the reaction chambers, the cover may be arranged to contact and trigger the controller switch when the cover is displaced to engage the mounting section, so that a time circuit of the controller may be activated to control and track heating start and stop times as well as the temperature. For example, the controller may activate the heating element(s) to reach a target temperature (e.g. 63+/−2° C.) within a set period of time (e.g. 1-3 minutes) and hold at that temperature during operation, e.g. for up to 60 minutes. Indicator lights may be used to signal heating and end of heating.

Sample Collection and Transfer to Amplification Cartridge

Additionally, a sample transfer or loading device or implement may be used with or as a part of a kit or system of the present invention, for delivering a sample (e.g. collected by a swab), to the sample receiving port of the amplification cartridge for identification. Various types of sample transfer/loading devices and mechanisms may be used, such as for example but not limited to (1) syringe-type devices, such as slip-tip syringe, Luer-lock syringe, catheter tip syringe, eccentric tip syringe, microtiter syringe, cartridge syringe, gastight syringe; (2) pipetteman; (3) serological pipette; (4) needle; (5) squeeze tube; (6) capillary tube, etc. It is appreciated that the nucleic acid amplification and detection device may also be provided as a kit which includes the amplification cartridge and heating apparatus, as well as the sample transfer tools, such as the sample transfer/loading unit or device, and collection swabs. In this regard, a basic nucleic acid amplification and detection kit may comprise: (1) one or more amplification cartridges, each having a plurality of reaction chambers for containing one or more reagents, a plurality of optically transparent view ports for viewing inside the reaction chambers, a sample receiving port adapted to receive a fluid sample and fluidically connected to distribute the fluid sample to the reaction chambers to mix with the reagent(s), and means for occluding fluidic communication to the reaction chambers; (2) a heating apparatus having a heating element, a controller adapted to activate the heating element to generate heat upon detecting a trigger event, and a cartridge-mounting section adapted to receive the amplification cartridge when loaded thereon so that the reaction chambers are in thermal communication with the heating element and so that the contents of the reaction chambers are viewable through the view ports; and (3) a sample transfer unit(s) adapted to interface with the sample receiving port for transferring the sample to the cartridge. Collection swabs may additionally be included as part of the kit.

Device Operation

Generally, operation of the multi-chamber, nucleic acid amplification and detection device begins with the loading (using a sample transfer unit) a fluid sample into the sample receiving port, where it is transported to the distribution chamber, and further distributed into each of the reaction chambers to mix with reaction components contained therein. For example, a fluid sample collected in the field and suspected of containing target organisms (e.g. pathogenic spores or cells) may be loaded into the amplification cartridge, distributed to the reaction chambers to mix with the reaction mixture, amplified by heating, and observed for color change. This may be accomplished for example by loading a swab with a collected sample into a buffer chamber of a sample transfer unit, and using the sample transfer unit to inject or otherwise introduce the fluid sample into the sample receiving port of the cartridge. In the alternative, the sample receiving port may be adapted (as a buffer chamber) to receive the fluid sample from the sample transfer unit, and to itself forcibly direct the fluid sample into the cartridge. In this case, the buffer chamber may be squeezed, for example, to transfer the fluid sample into equal volume reaction chambers pre-loaded with amplification and detection reagents specific for target organisms plus positive and negative controls. Additionally, the sample receiving port may be adapted to receive a sample-collected swab directly, as well as a buffer solution, and operable (such as by squeezing) to forcibly direct the fluid sample into the distribution chamber for distribution to the reaction chambers.

After the fluid sample is distributed into the reaction chambers, the reaction chambers are then occluded and sealed so as to prevent backflow and cross-contamination. In one example embodiment, the pathways from the sample receiving port to the reaction chambers may be occluded or sealed manually, such as by engaging/depressing a plunger, prior to loading into the heater. In an alternative embodiment, the pathways from the sample receiving port to the reaction chambers may be automatically occluded or sealed upon loading the cartridge in the mounting section of the heating unit, or upon closing the heating unit such as by covering the loaded cartridge with a cover.

After or concurrently with occluding/sealing the reaction chambers, the heater unit is activated to heat the reaction chambers. Activation may be initiated by a trigger event, detected by the controller, which causes the controller to activate the heating element to heat the reaction chambers for a predetermined period of time. The trigger event may be manual or automatic, as previously described. In one example embodiment, the cartridge may subsequently be removed from the heating apparatus in order to visually inspect the reaction chambers through the view ports for any visual changes, e.g. color change, indicative of a positive reaction. In the alternative, the cover may have view ports which align with the view ports of the loaded amplification cartridge, to enable visual inspection of the reaction chambers and its contents during heating.

In one example embodiment, lyophilized reaction components are used in an isothermal amplification technique. LAMP assays targeting specific biological threat organisms are pre-loaded into the reaction wells. An unknown sample is collected with a swab and distributed into a buffer in a transfer device. The transfer device containing buffer plus unknown sample is loaded onto the sample receiving port and squeezed to transfer the fluid into the distribution chamber/well. The fluid flows into the individual reaction chamber/wells and the plunger is depressed to occlude the reaction chamber/wells preventing backflow and cross-contamination. The heater lid or cover is closed triggering heating to 63+/−2 C for 60 minutes. The user visually inspects the reaction chamber/wells through optically transparent windows for color change in the positive control well and the sample wells. No color change should be detected in the negative control well. Any positive sample well indicates the target organism present in the original sample.

Example Embodiments

In one example implementation, the present invention includes a nucleic acid amplification and detection device, comprising: an amplification cartridge having a plurality of reaction chambers for containing an amplification reagent and a visual detection reagent, a plurality of optically transparent view ports for viewing inside the reaction chambers, a sample receiving port adapted to receive a fluid sample and fluidically connected to distribute the fluid sample to the reaction chambers, and means for occluding fluidic communication to the reaction chambers; and a heating apparatus having a heating element, a controller adapted to activate the heating element to generate heat upon detecting a trigger event, and a cartridge-mounting section adapted to receive the amplification cartridge when loaded thereon so that the reaction chambers are in thermal communication with the heating element and so that visual changes to the contents of the reaction chambers are viewable through the view ports.

In some embodiments of the nucleic acid amplification and detection device, the sample receiving port may be fluidically connected to the reaction chambers via a distribution chamber having a plurality of inlets leading to the respective reaction chambers. Furthermore, the means for occluding fluidic communication to the reaction chambers may include a plunger actuable from a first position not occluding the inlets to a second position occluding the inlets.

In some embodiments of the nucleic acid amplification and detection device, the device further comprises the amplification reagent and the visual detection reagent pre-loaded in the reaction chambers. And furthermore, the pre-loaded reagents may be lyophilized.

In some embodiments of the nucleic acid amplification and detection device, the cartridge-mounting section may have a plurality of heating wells in thermal communication with the heating element and adapted to receive therein the reaction chambers of the amplification cartridge. Furthermore, the heating element may include a plurality of heating sub-elements each in thermal communication with a corresponding one of the heating wells.

In some embodiments of the nucleic acid amplification and detection device, the heating apparatus may include a cover adapted to engage the cartridge-mounting section so as to cover a loaded amplification cartridge. Furthermore, the cover may have view ports arranged to align with the view ports of the loaded amplification cartridge when the cover is engaged to cover the loaded amplification cartridge so that visual changes to the contents of the reaction chambers are viewable through the cover view ports. Or the trigger event may be the engagement of the cover to cover the loaded amplification cartridge. Or the means for occluding fluidic communication to the reaction chambers may be adapted to be activated by the cover upon engagement of the cover to cover the loaded amplification cartridge.

In another example implementation, the present invention includes a multi-chamber, nucleic acid amplification cartridge for use with a heating apparatus of a type having a heating element and a cartridge-mounting section adapted to receive the amplification cartridge when loaded thereon, comprising: a cartridge body having a plurality of reaction chambers for containing an amplification reagent and a visual detection reagent, a plurality of optically transparent view ports for viewing inside the reaction chambers, and a sample receiving port adapted to receive a fluid sample and fluidically connected to distribute the fluid sample to the reaction chambers, wherein the reaction chambers are located on the cartridge body so as to be in thermal communication with the heating element when the amplification cartridge is loaded on the cartridge-mounting section of the heating apparatus, and wherein the view ports are located on the cartridge body so that the contents of the reaction chambers are viewable through the view ports when the amplification cartridge is loaded on the cartridge-mounting section of the heating apparatus; and means for occluding fluidic communication to the reaction chambers.

In some embodiments of the multi-chamber nucleic acid amplification cartridge, the sample receiving port may be fluidically connected to the reaction chambers via a distribution chamber having a plurality of inlets leading to the respective reaction chambers, and furthermore, the means for occluding fluidic communication to the reaction chambers may include a plunger actuable from a first position not occluding the inlets to a second position occluding the inlets.

In some embodiments of the multi-chamber nucleic acid amplification cartridge, the cartridge further comprises the amplification reagent and the visual detection reagent pre-loaded in the reaction chambers, and furthermore, the pre-loaded reagents may be lyophilized.

In another example implementation, the present invention includes a heating apparatus for use with a multi-chamber nucleic acid amplification cartridge of a type having a plurality of reaction chambers and a plurality of optically transparent view ports for viewing inside the reaction chambers, comprising: a heating element; a controller adapted to activate the heating element to generate heat upon detecting a trigger event; and a cartridge-mounting section adapted to receive the amplification cartridge when loaded thereon so that the reaction chambers are in thermal communication with the heating element and so that visual changes to the contents of the reaction chambers are viewable through the view ports.

In some embodiments of the heating apparatus, the cartridge-mounting section may have a plurality of heating wells in thermal communication with the heating element and adapted to receive therein the reaction chambers of the amplification cartridge, and furthermore, the heating element may include a plurality of heating sub-elements each in thermal communication with a corresponding one of the heating wells.

In some embodiments of the heating apparatus, the heating apparatus may include a cover adapted to engage the cartridge-mounting section so as to cover a loaded amplification cartridge. Furthermore, the cover may have view ports arranged to align with the view ports of the loaded amplification cartridge when the cover is engaged to cover the loaded amplification cartridge so that visual changes to the contents of the reaction chambers are viewable through the cover view ports. Or the trigger event may be the engagement of the cover to cover the loaded amplification cartridge.

These and other implementations and various features and operations are described in greater detail in the drawings, the description and the claims.

BRIEF DESCRIPTION OF THE DRAWINGS

The accompanying drawings, which are incorporated into and form a part of the disclosure, are as follows.

DETAILED DESCRIPTION

Figure 1:
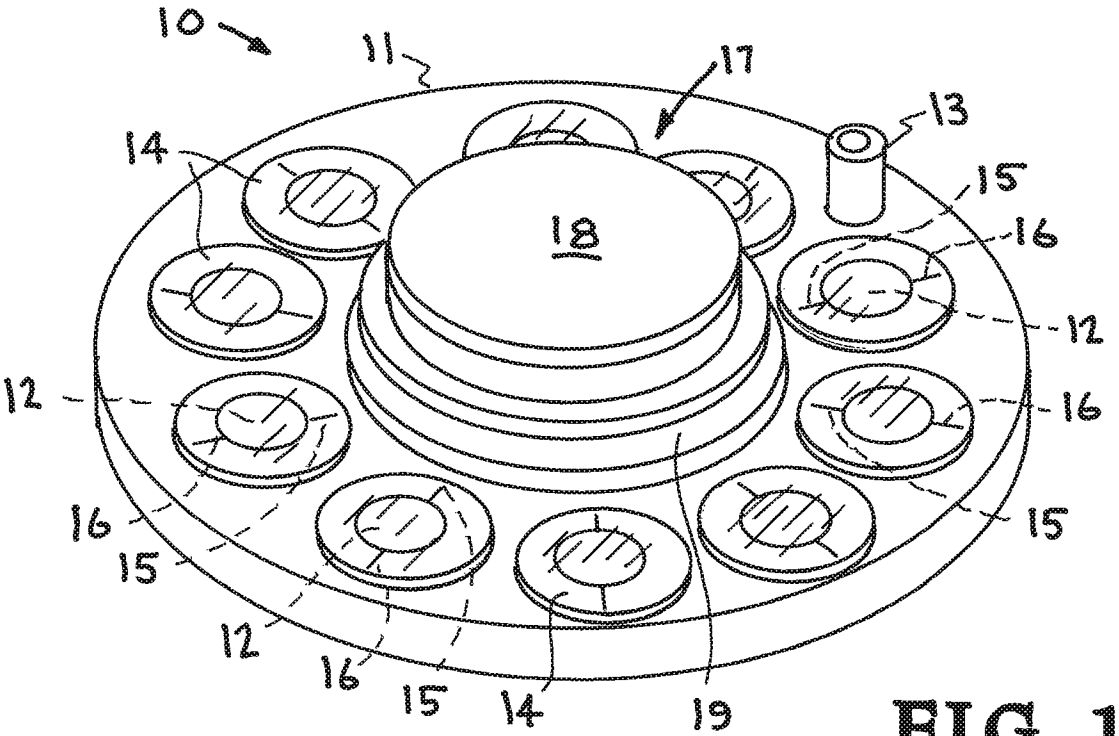
FIG. 1 is a perspective view of an example embodiment of the amplification cartridge of the present invention.
Figure 2:
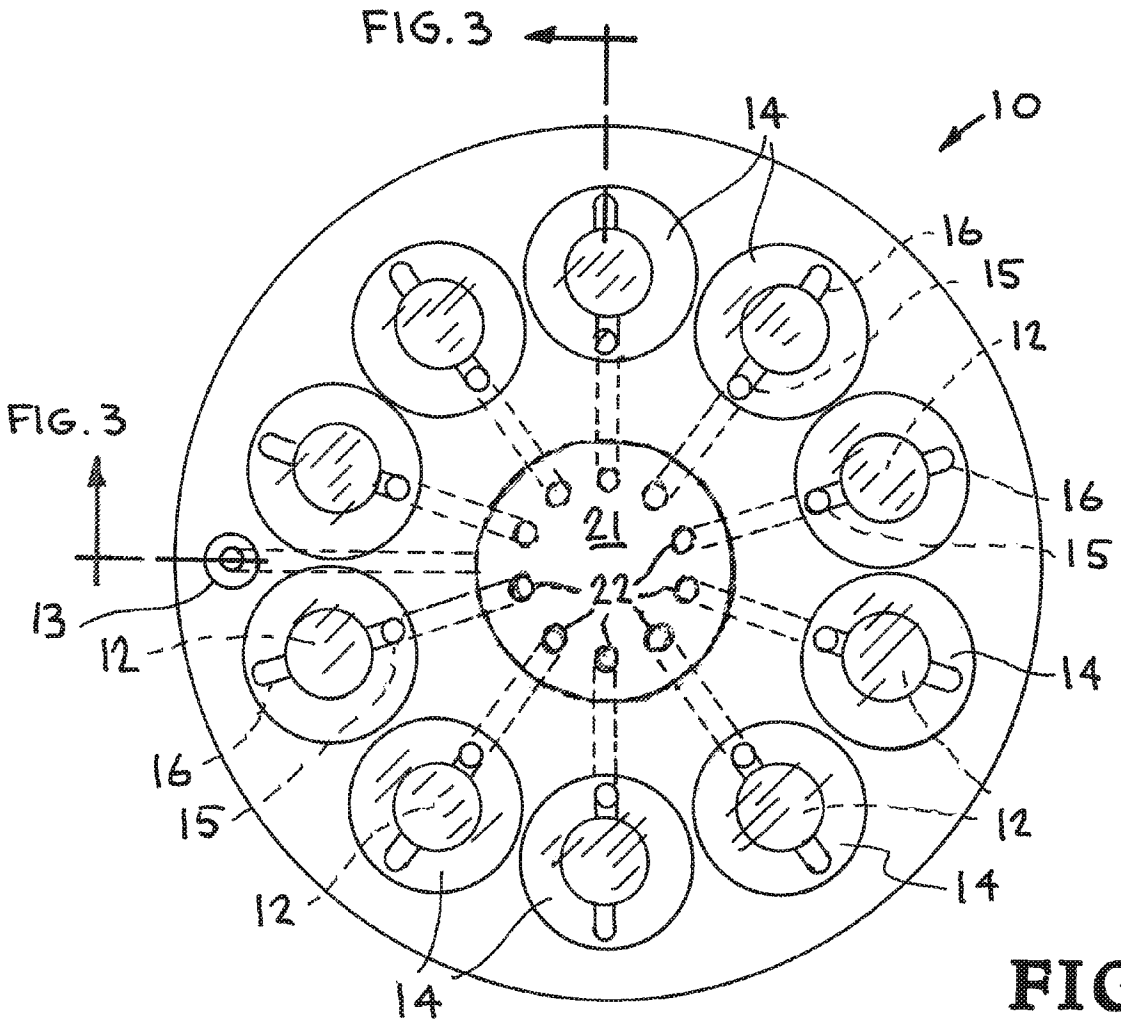
FIG. 2 is a top schematic view of the amplification cartridge of FIG. 1 with the plunger assembly removed to view the distribution chamber.
Figure 3:
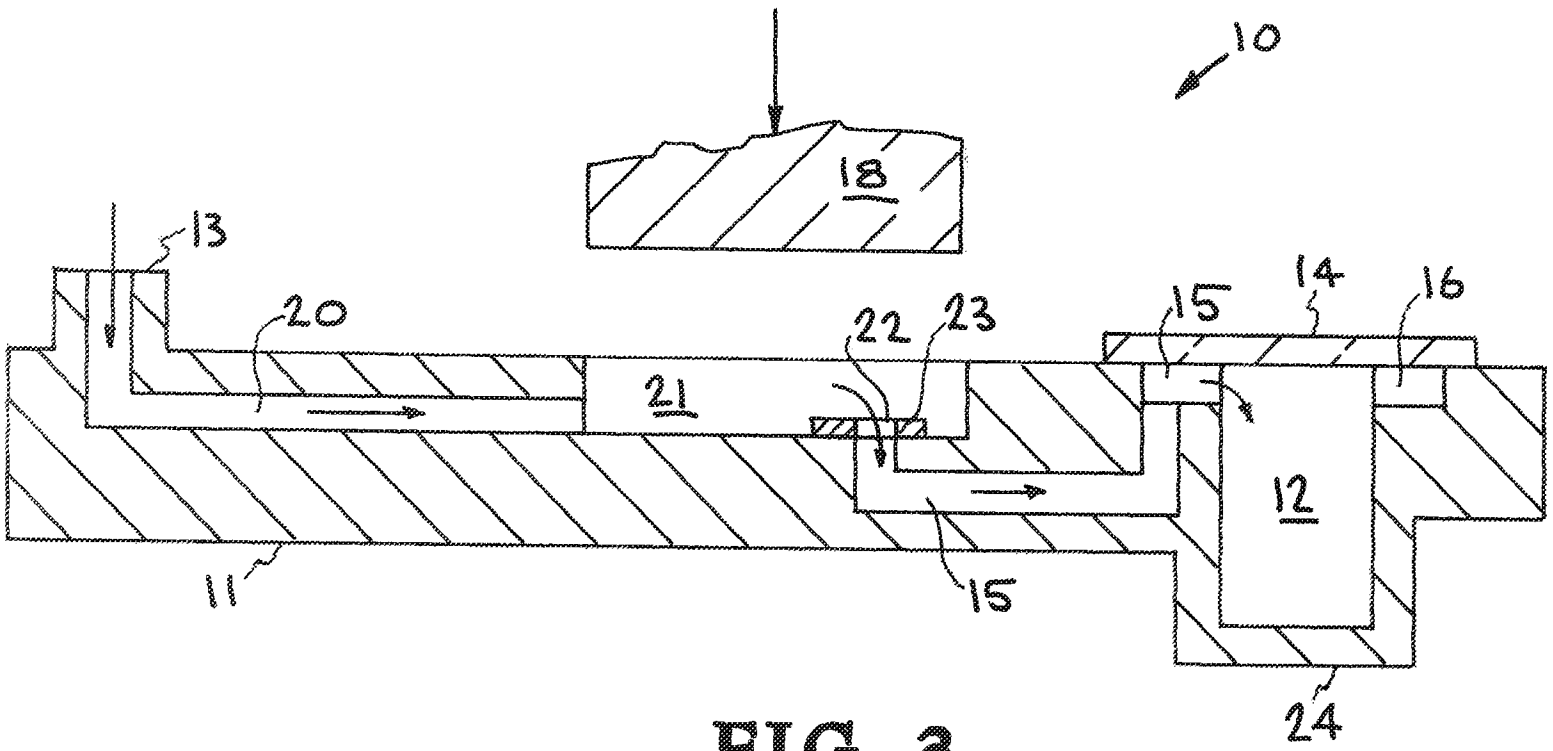
FIG. 3 is a radial cross-sectional view of the amplification cartridge of FIG. 2 taken along radial lines labeled "FIG. 3", illustrating the flow of a fluid sample from the sample receiving port to one of the reaction chambers.

Turning to the drawings, FIGS. 1-3 show an example embodiment of a multi-chamber, nucleic acid amplification cartridge of the present invention, generally indicated at reference character 10. As best shown in the perspective view of FIG. 1, the amplification cartridge has a cartridge body 11 (e.g. shown having a generally disc-shape), and a plunger assembly 17 located at the center of the cartridge body with a plunger 18 actuably carried on a plunger base mount 19 which may be connected to or an extension of the cartridge body. A plurality of reaction chambers 12 are also shown provided as cavities in the cartridge body, which are radially spaced from and arranged around the plunger assembly in a generally hub-and-spoke configuration, and which form cavity openings on one side (e.g. a top side) of the cavity body. And a sample receiving port 13 is also shown provided on the cartridge body for receiving a fluid sample (not shown) and distributing the fluid sample to each of the reaction chambers where it may mix with amplification and visual detection reagents which may be pre-loaded in the reaction chambers, or otherwise provided therein.

The inside of the reaction chambers/cavities and its contents are viewable through optically transparent view ports/windows comprising optically transparent materials, such as glass, plastic, etc. which are arranged to sealably cover the reaction chamber/cavity openings. In FIGS. 1-3, the optically transparent materials are shown provided as a plurality of optically transparent window units 14, each sealably covering a cavity opening of a corresponding one of the reaction chambers 12. It is appreciated, in the alternative, that the optically transparent material may be provided as a single monolithic body (e.g. a ring-shaped structure) which sealably covers all reaction chamber openings, or two or more monolithic bodies, each sealably covering two or more reaction chamber openings.

FIG. 2 also shows the amplification cartridge 10 of FIG. 1, but with the plunger assembly 17 removed to expose a distribution chamber 21 which is in fluidic communication with the sample receiving port 13 and each of the reaction chambers 12. In particular, a plurality of inlets 22 is shown in the distribution chamber 21 which allows fluid to pass out from the distribution chamber and into the reaction chambers via fluidic channels or conduits. FIG. 3 particularly shows the distribution path of a fluid sample introduced through the sample receiving port 13 to the reaction chambers. As shown by the arrows, a fluid sample is first introduced into the cartridge body 11 through sample receiving port 13 where it is transported radially inward to the distribution chamber 21 via fluidic conduit 20. From the distribution chamber, the fluid sample is passed into inlet 22, and transported radially outward via fluidic conduit 15, and into each of the reaction chambers, such as representative reaction chamber 12.

Once the reaction chambers are loaded with the fluid sample, the plunger 18 of the plunger assembly may be actuated in the direction of the arrow in FIG. 3, i.e. toward the cartridge body, to occlude the inlets such as representative inlet 22. Inlet 22 is particularly shown with a seal 23 surrounding the inlet, which when brought into contact with the plunger 18 (i.e. when the plunger is actuated to a position which occludes fluidic communication between the distribution chamber 21 and the inlet 22 and reaction chamber 12) seals entry to or exit from the reaction chambers. The seal may be, for example, a raised collar, flange, O-ring, or other sealing material or structure. Backflow of a fluid sample may be prevented in this manner to isolate and prevent cross-contamination of the reaction chambers from each other. It is also appreciated that a separate diaphragm may be positioned adjacent the inlet 22 so as to be urged by the plunger against the inlets to occlude the inlets. When loaded into the reaction chambers, the fluid sample is viewable through the optically transparent view port 14, as well as a colorimetrically detectable reaction the fluid sample may have with amplification and detection agents contained in the chambers. FIGS. 1-3 also show expansion slots 16 fluidically connected to the reaction chambers for relieving pressure as fluid enters. Furthermore, an absorbent material, such as a sponge, may be provided for trapping excess fluid.

Figure 4:
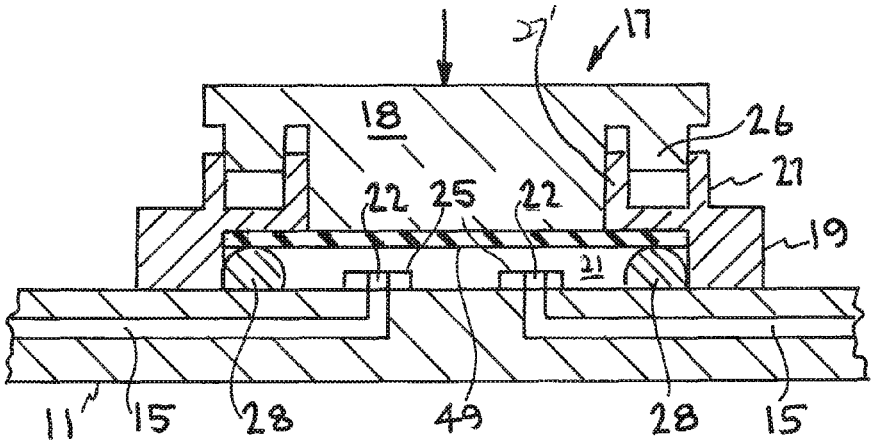
FIG. 4 is a cross-sectional view of a plunger assembly of an example embodiment of the amplification cartridge of the present invention, shown in a first position not occluding/sealing the inlets to the reaction chamber.
Figure 5:
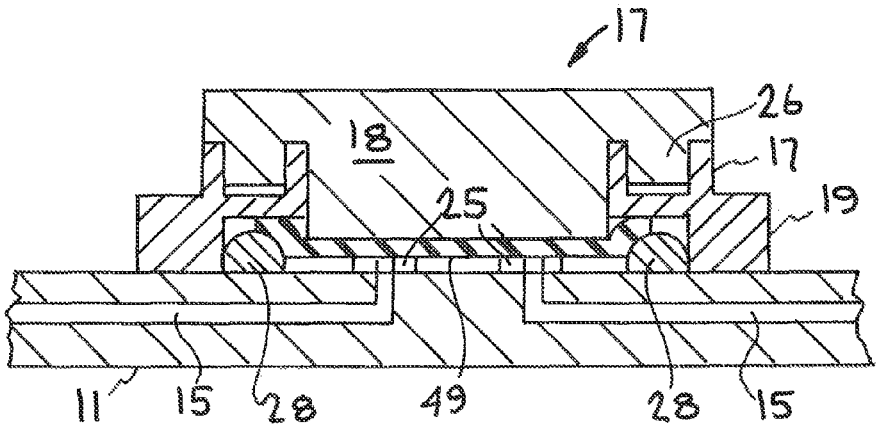
FIG. 5 is a cross-sectional view of the plunger assembly following FIG. 4, shown in a second position occluding/sealing the inlets to the reaction chamber.

FIGS. 4 and 5 show cross-sectional views of a plunger assembly of another example embodiment of the amplification cartridge of the present invention, shown in a first position in FIG. 4 not occluding/sealing the inlets to the reaction chamber, and in a second position in FIG. 5 occluding/sealing the inlets to the reaction chamber. The cartridge body 11 is shown having fluidic channels/conduits 15 terminating at inlets 22 in the distribution chamber 21. Seals 25 are also shown in the distribution chamber surrounding the inlets. And a plunger base mount 19 is shown having a lower cavity which together with the cavity body 11 forms the distribution chamber 21, and an upper cavity in which the center of the plunger is actuably positioned to be displaced into and out of the lower cavity. Also shown in the distribution chamber 21 is a sealing diaphragm 49 (e.g. made of a flexible or resiliently biasing material, such as rubber) held away from the inlets 22 by a spacer 28, which may be a large diameter O-ring, block, or other structure which suspends the sealing diaphragm in a non-occluding position as shown in FIG. 4. As shown between FIGS. 4 and 5, when the plunger 18 is actuated toward the cavity body 11, the plunger 18 urges the diaphragm 49 toward the inlets 2, until a sealing contact is made with the seals 25. The plunger base mount 19 is also shown having a guide track formed between walls 27 and 27' in which a guide arm 26 of the plunger may be moved. In some embodiments, the guide arms 26 may be configured for a friction fit in the guide track such that the plunger 18 may remain in the occluding position once actuated.

Figure 6:
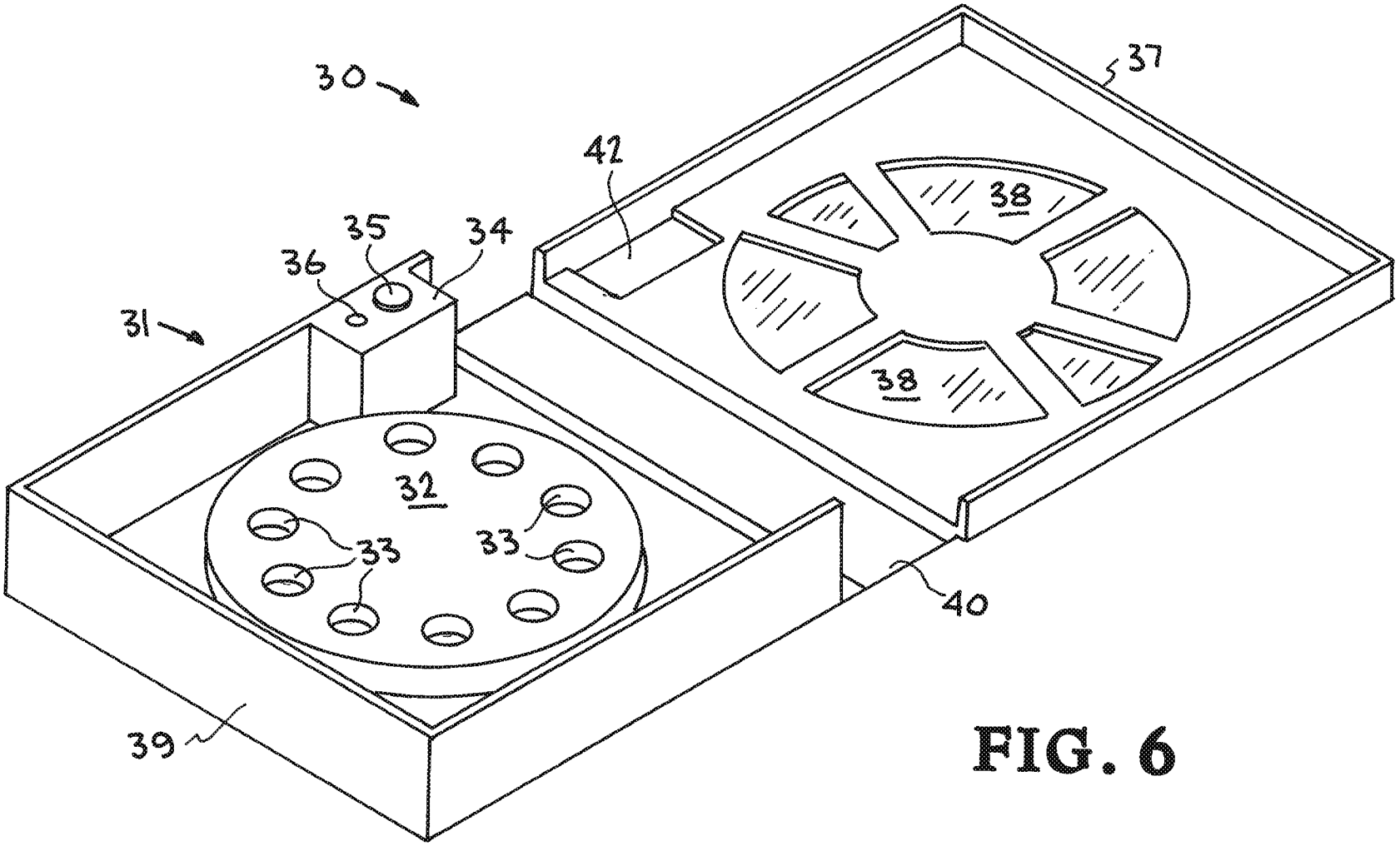
FIG. 6 is a perspective view of an example embodiment of the heating apparatus of the present invention.
Figure 7:
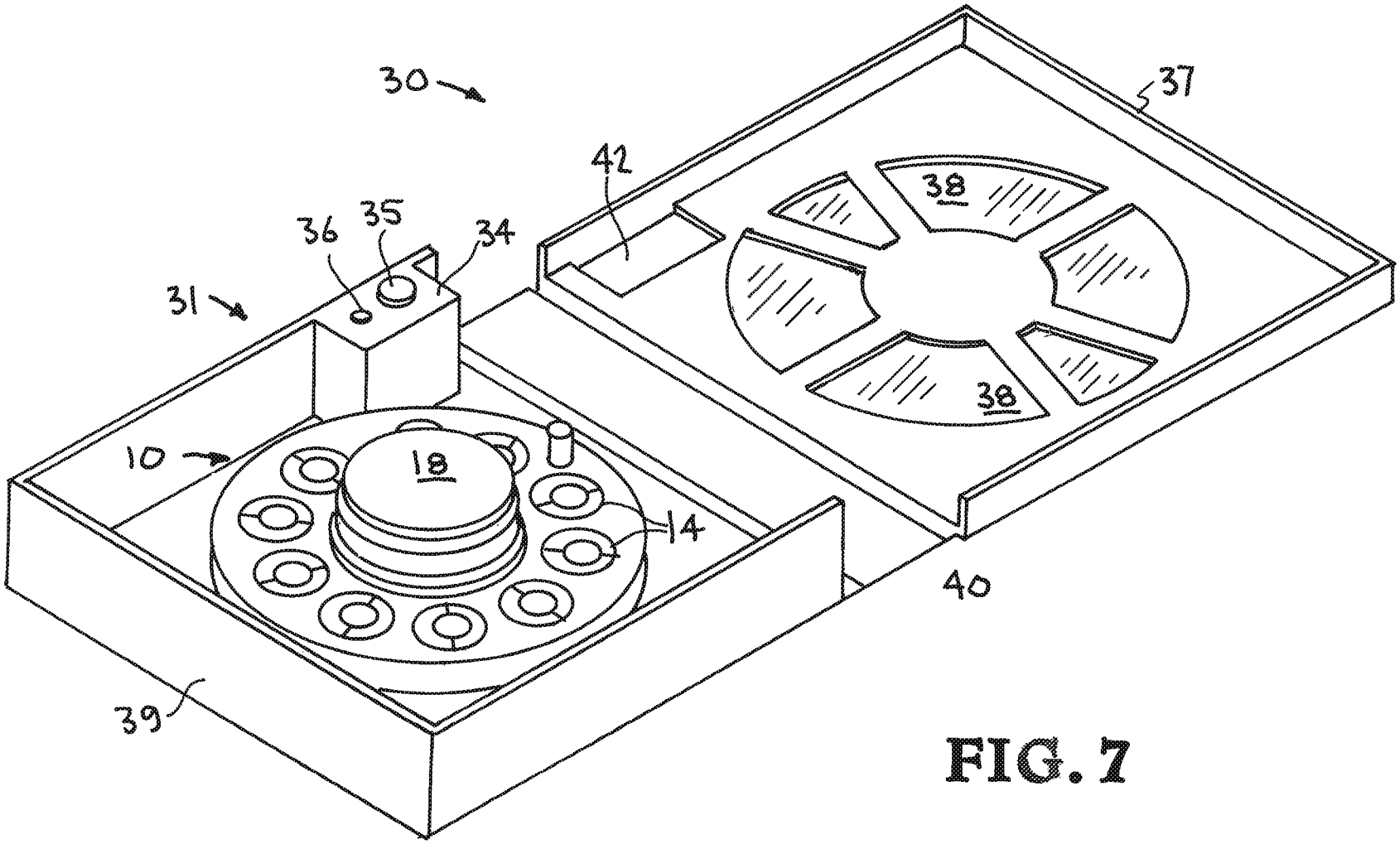
FIG. 7 is a perspective view of the amplification cartridge of FIG. 1 loaded in the heating apparatus of FIG. 6.
Figure 8:
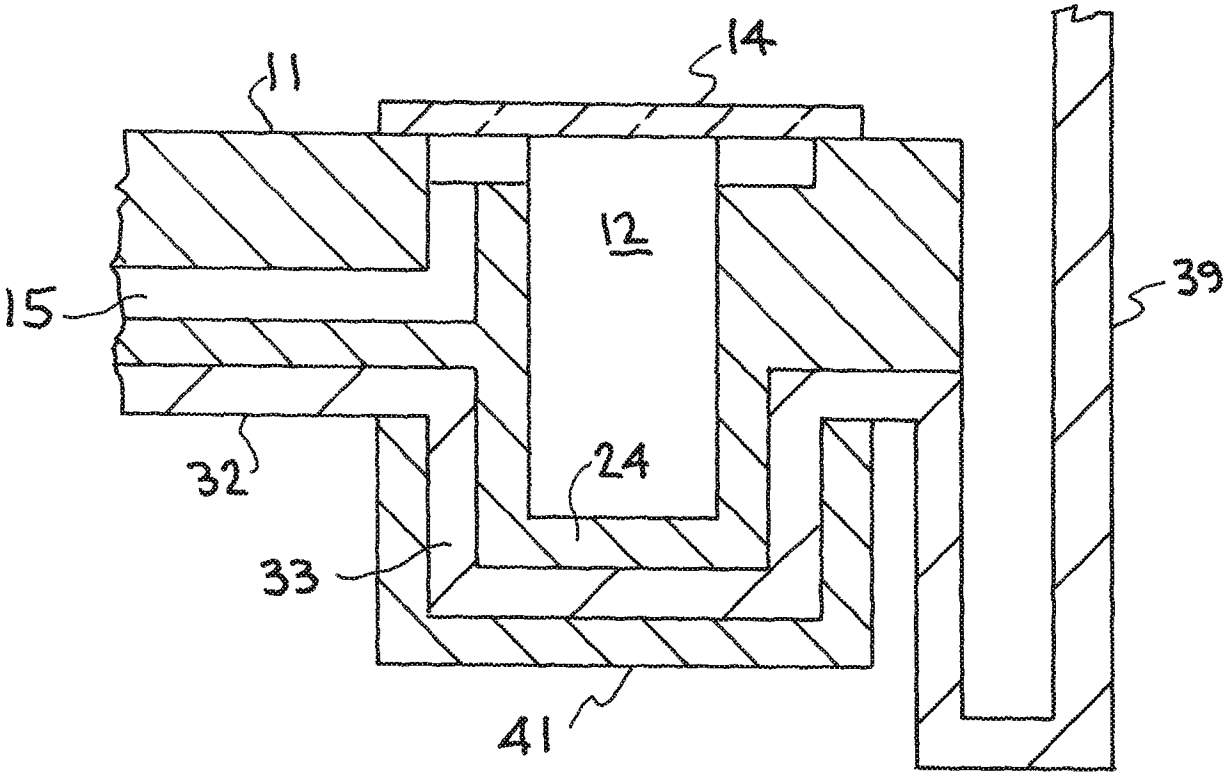
FIG. 8 is a partial cross-sectional view of the amplification cartridge and heating apparatus of FIG. 7, showing a reaction chamber seated in a heating well of the heating apparatus.

FIG. 6 shows an example embodiment of the heating apparatus of the present invention, generally indicated at 30, having a cartridge mounting section 31 that is adapted and configured to receive an amplification cartridge, such as 10 in FIG. 7, that may be loaded onto it for heating the reaction chambers, so that the reaction chambers of the cartridge are in thermal communication with a heating element (or sub-elements) and so that visual changes to the contents of the reaction chambers are viewable through the view ports. In FIG. 6, the mounting section 31 is shown having a centrally located raised platform 32 with a plurality of open cavities, i.e. heating wells 33, formed thereon, and with the heating element or sub-elements arranged to heat the wells. The raised platform is particularly shown having the same generally disk-shape of the amplification cartridge 10, with the heating wells 33 radially arranged to receive the reaction chambers into the cavities. For this purpose, and as shown in FIG. 3, the reaction chamber 12 may be formed in part by lower wall and floor 24 sections which protrude and otherwise extend below the cavity body 11, so that the protruding chambers may be seated in the heating wells 33 of the heating unit. This is best shown in FIG. 8 where the raised platform 32 and the wells 33 (i.e. cavity walls) are particularly shown integrally connected to perimeter walls 39 which surround and encase the raised platform 32 of the mounting section 31. FIG. 8 also shows one embodiment of the heating element 41 which is positioned on the outside of the heating wells and cavity walls 33 for heating the cavity and the reaction chamber 12 positioned therein. It is appreciated that the heating element may in the alternative be disposed in the cavities of the heating wells, or integrally formed in the walls of the heating wells, or provided as a single or multiple heating elements, with each heating element arranged to heat multiple reaction chambers together. It is also appreciated that the cartridge mounting section can be adapted to simply receive a cartridge, such as a form fitting space with no direct attachment or mounting mechanism, or in the alternative, be adapted to mount or releasably attach, hold, or secure a cartridge, such as by using a fastening mechanism such as for example clamps.

FIGS. 6-9 also show included on the cartridge mounting section 31 a controller 34, including control electronics, such as for exampling a time circuit, for controlling reaction temperature and for controlling reaction start and stop times. An onboard power source, e.g. a battery not shown, may also be provided with the controller 34 for powering the controller, the heating element 41, and other electronics features provided on the heating unit. It is appreciated, however, that the heating unit may include connectors, such as a power cord and outlet plug, for connecting to an off-board power source, such as an electrical outlet. In this manner, the heating unit may be used to maintain an optimum reaction temperature(s) across the reaction chambers. Also shown provided is an activation switch 35 for initiating the controller to heat the reaction chambers. Optionally, an indicator light such as 36 may also be provided.

Figure 9:
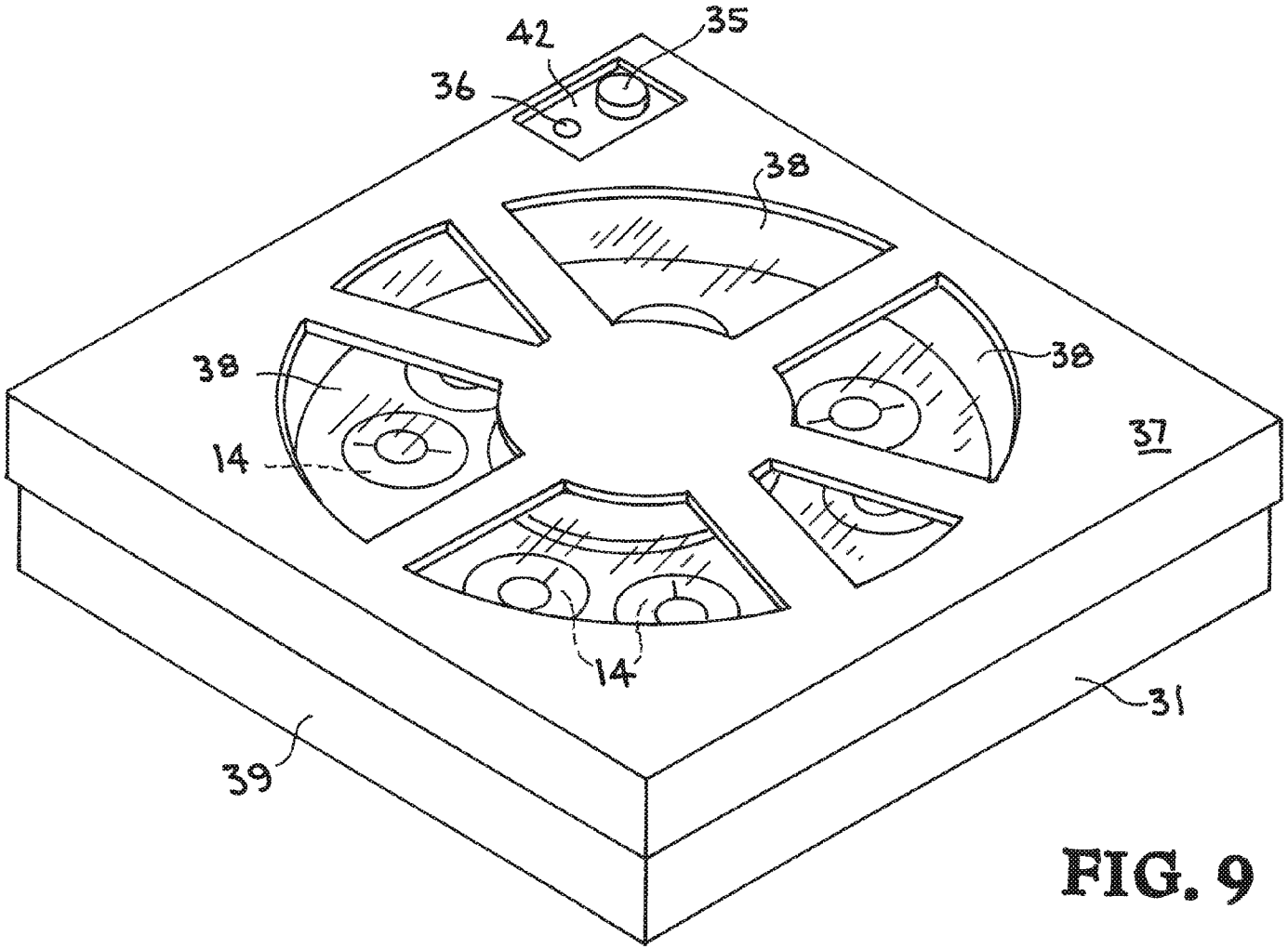
FIG. 9 is a perspective view of the amplification cartridge and heating apparatus of FIG. 8, shown with the cover engaged to the cartridge-mounting section to close the heating apparatus and cover the loaded amplification cartridge.

As shown in FIGS. 6, 7, and 9 the heating unit 30 may also include a cover section or outer shell 37 for covering the mounting section 31 and any cartridge that may be positioned thereon. In particular, the cover section 37 is adapted to engage the cartridge-mounting section so as to cover a cartridge that is loaded on the cartridge mounting section, and is shown in particular hingedly connected to the mounting section 31 by hinge 40. The cover is shown having optically transparent windows 38 arranged to align with the optically transparent view ports 14 of a mounted cartridge 10, as shown in FIG. 9, for viewing reaction progress during heating. It is appreciated that the view ports on the cover may either be an opening or an optically transparent material. The cover 37 is also shown having a cutout 42 which allows the activation switch 35 and heating indicator light 36 to be viewable therethrough. For the switch, this enables manual activation of the heating operation after the cover is positioned to close the heating unit. In the alternative, the cutout 42 may be removed so that the cover contacts and activates the switch when closed over the mounting section 31, to automatically initiate heating.

Although the description above contains many details and specifics, these should not be construed as limiting the scope of the invention but as merely providing illustrations of some of the presently preferred embodiments of this invention. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present invention fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

I claim:

1. A nucleic acid amplification and detection device, comprising:

an amplification cartridge having distribution chamber, a plurality of reaction chambers all arranged around and adjacent the distribution chamber in a hub-and-spoke configuration for containing an amplification reagent and a visual detection reagent and wherein the distribution chamber has a plurality of inlets leading to the respective reaction chambers, a plurality of optically transparent view ports for viewing inside the reaction chambers, a sample receiving port adapted to receive a fluid sample and fluidically connected to distribute the fluid sample to the reaction chambers via the distribution chamber, and a plunger positioned in the distribution chamber and actuable from the first position not occluding the inlets to a second position occluding the inlets for simultaneously occluding fluidic communication to all the reaction chambers; and a heating apparatus having a heating element, a controller adapted to activate the heating element to generate heat upon detecting a trigger even, and a cartridge-mounting section adapted to receive the amplification cartridge when loaded thereon so that the reaction chambers are in thermal communication with the heating element and so that visual changes to the contents of the reaction chambers are viewable through the view ports.

2. The nucleic acid amplification and detection device of claim 1, further comprising the amplification reagent and the visual detection reagent pre-loaded in the reaction chambers.

3. The nucleic acid amplification and detection device of claim 2, wherein the pre-loaded reagents are lyophilized.

4. The nucleic acid amplification and detection device of claim 1, wherein the cartridge-mounting section has a plural of heating wells in thermal communication with the heating element and adapted to receive therein the reaction chambers of the amplification cartridge.

5. The nucleic acid amplification and detection device of claim 4, wherein the heating element includes a plurality heating sub-elements each in thermal communication with a corresponding one of the heating wells.

6. The nucleic acid amplification and detection device of claim 1, wherein the heating apparatus includes a cover adapted to engage the cartridge-mounting section so as to cover a loaded amplification cartridge.

7. The nucleic acid amplification and detection device of claim 6, wherein the cover has view ports arranged to align with the view ports of the loaded amplification cartridge when the cover is engaged to cover the loaded amplification cartridge so that visual changes to the contents of the reaction chambers are viewable through the cover view ports.

8. The nucleic acid amplification and detection device of claim 6, wherein the trigger event is the engagement of the cover to cover the loaded amplification cartridge.

9. The nucleic acid amplification and detection device of claim 6, wherein the means for occluding fluidic communication to the reaction chambers is adapted to be activated by the cover upon engagement of the cover to cover the loaded amplification cartridge.

10. A multi-chamber, nucleic acid amplification cartridge for use with a heating apparatus of a type having a heating element and a cartridge-mounting section adapted to receive the amplification cartridge when loaded thereon, comprising;

a cartridge body having a distribution chamber, a plurality of reaction chambers all arranged around and adjacent the distribution chamber in a hub-and-spoke configuration for containing an amplification reagent and a visual detection reagent and wherein the distribution chamber has a plurality of inlets leading to the respective reaction chambers, a plurality of optically transparent view ports for viewing inside the reaction chambers, and a sample receiving port adapted to receive a fluid sample and fluidically connected to distribute the fluid sample to the reaction chambers via the distribution chamber, wherein the reaction chambers are located on the cartridge body so as to be in thermal communication with the heating element when the amplification cartridge is loaded on the cartridge-mounting section of the heating apparatus, and wherein the view ports are located on the cartridge body so that the contents of the reaction chambers are viewable through the view ports when the amplification cartridge is loaded on the cartridge-mounting section of the heating apparatus; and a plunger positioned in the distribution chamber and actuable from a first position not occluding the inlets to a second position occluding the inlets for simultaneously occluding fludic communication to all the reaction chambers.

11. The multi-chamber nucleic acid amplification cartridge of claim 10, further comprising the amplification reagent and the visual detection reagent pre-loaded in the reaction chambers.

12. The multi-chamber nucleic acid amplification cartridge of claim 11, wherein the pre-loaded reagents are lyophilized.

* * * * *